United States Patent [19]

Welch et al.

[11] 4,108,702

[45] Aug. 22, 1978

[54] METHOD OF FORMING AN ARTICLE-TAPE PRODUCT

[75] Inventors: Richard D. Welch, Pittsford; John E. Iversen, Rochester, both of N.Y.

[73] Assignee: Eastman Kodak Company, Rochester, N.Y.

[21] Appl. No.: 777,237

[22] Filed: Mar. 11, 1977

Related U.S. Application Data

[62] Division of Ser. No. 615,031, Sep. 19, 1975, which is a division of Ser. No. 483,586, Jun. 27, 1974, abandoned.

[51] Int. Cl.[2] ..... B31C 13/00; B65B 15/04

[52] U.S. Cl. ..... 156/192; 53/3; 156/297; 156/362; 193/38; 242/75.52; 354/304

[58] Field of Search ..... 156/297, 358, 361, 543, 156/552, 560, 561, 562, 564, 573, 184, 192, 362; 53/196, 3; 206/345, 460, 813; 354/304; 193/25 FT, 38, 47, 44; 242/75.52, 67.3

[56] References Cited

U.S. PATENT DOCUMENTS

| | | | |
|---|---|---|---|
| 1,710,393 | 4/1929 | Williams | 206/122 |
| 2,677,317 | 5/1954 | Vogt | 53/196 X |
| 2,712,441 | 7/1955 | Ray | 156/552 X |
| 2,779,385 | 1/1957 | Carlzen et al. | 156/297 X |
| 3,215,582 | 11/1965 | Carter | 156/564 |
| 3,751,324 | 8/1973 | Enskat | 156/560 X |
| 4,018,643 | 5/1976 | Levine | 156/297 |

*Primary Examiner*—William A. Powell
*Assistant Examiner*—Thomas Bokan
*Attorney, Agent, or Firm*—S. W. Gremban

[57] ABSTRACT

A method of adhering a plurality of articles, each having one marginal edge thicker than the opposite marginal edge onto a tape to form an article-tape product. The article may be a pod which is usable, for example, in instant photographic products where the pod is interposed between image-recording and print receiving sheets and advanced between a pair of pressure applying members for rupturing the pod and dispensing and distributing the processing liquid between the sheets.

9 Claims, 9 Drawing Figures

METHOD OF FORMING AN ARTICLE-TAPE PRODUCT

This is a division, of application Ser. No. 615,031 filed Sept. 19, 1975 which in turn is a divisional of application Ser. No. 483,586, filed June 27, 1974, abandoned.

BACKGROUND OF THE INVENTION

1. Field of the Invention

This invention relates generally to the storing and dispensing of photographic containers such as a rupturable pod containing a processing liquid, and more specifically to an apparatus and method for forming a photographic pod-tape product for storing and dispensing pods.

2. Description of the Prior Art

It is known in the photographic art to provide rupturable photographic containers such as pods of the type comprising a pair of facing rectangular walls formed of deformable sheet material secured to one another at their marginal edges to form a cavity for a liquid processing agent. Such containers are usable in film units of the type comprising an image-recording sheet, and a print-receiving sheet which is superposed with the image-recording sheet during processing. The two sheets have a rupturable photographic pod associated therewith, and processing of the film unit is effected by feeding the film unit through a pair of pressure-applying rolls. The rolls rupture the pod and distribute the processing liquid from the pod in a layer between the image recording and print-receiving sheets for processing the previously exposed image-recording sheet.

In the manufacture of film units of the aforementioned type, it is known to store the rupturable photographic pods in magazines or the like, by stacking a quantity of the pods, like a deck of cards, inside the magazine. When it is desired to feed the pods onto a web or the like for forming film units, the pods are preferably pushed out of the magazine into a feed chute as a free stack of pods. One disadvantage of manually storing and handling the pods in this manner is that premature rupture of a pod and release of the liquid may result. This problem is further aggravated by the fact that the liquid content in many instances is viscous, hardens on exposure to air and is highly corrosive. Another product capable of storing and handling photographic pods is disclosed in U.S. Pat. No. 3,246,739. This photographic product comprises spaced pods connected to one another by a pair of narrow elongated connecting members secured in substantially parallel relation to the end marginal portion of the pods. The pods are positioned with longitudinal marginal portions in substantially parallel relation, facing in the same direction, and are spaced from one another so that the product resembles a ladder with the pods corresponding to the rungs of the ladder. The ladder of pods is stored by winding the ladder onto a reel or the like. One disadvatage of this product is that it is complicated and hence difficult and costly to manufacture. Another disadvantage of this product when used for storing and dispensing pods is that the volume of pods that can be stored on one reel is relatively small. Consequently, the pods cannot be fed rapidly from the storage strip with the result that the rate of manufacture of film units is low. In addition, a severing mechanism is necessary for severing the connecting members between successive pods to permit the pods to be fed, one at a time, into association with a sheet over which the liquid content is to be distributed. Another disadvantage of this product when wound in a roll is that the pods in certain instances are in overlying relation and any force directed radially inwardly on the roll due to, for example, a buildup of convolutions of product may rupture one or more of the pods.

It is further known in the art to provide apparatus and methods for affixing articles to the adhesive surface of a continuous web, and to wind the web on a reel to form a storage unit from which the articles may be individually dispensed. U.S. Pat. Nos. 3,140,010 and 3,713,955 are exemplary of such apparatus and methods. None of such apparatus or methods, however, is capable of forming a photographic pod-tape product for storing and dispensing photographic pods.

SUMMARY OF THE INVENTION

In accordance with a preferred embodiment of the invention, an apparatus and method is disclosed for adhering rupturable photographic pods onto a tape to form a photographic pod-tape product for storing and dispensing pods. The photographic pod-tape product comprises a stack of photographic pods, each pod having a pair of facing rectangular walls formed of deformable sheet material and secured to one another at their marginal edges to form an enclosed cavity containing a liquid photographic processing agent. The product further comprises a tape having an adhesive surface secured to one of the marginal edges of each of the pods.

The apparatus of this invention for forming a photographic pod-tape product comprises an elongated pod collecting chute having entry and exit openings. The chute has a slot along one side for exposing the edges of a stack of pods fed therein. The chute has at least a portion thereof of a width less than the width of a pod so that pods fed therein are inclined at an acute angle to a plane perpendicular to the longitudinal axis of the chute. This permits the pods, which normally are thicker along one of two opposite edges, to stack properly. The mechanism further has means such as a roller extending into the slot for transporting a tape and applying the adhesive surface of the tape into engagement with the exposed edges of a stack of the pods. The tape and pods adhering thereto form a photographic pod-tape product which is wound onto a driven take-up reel.

The method of this invention for forming the pod-tape product with the described apparatus comprises feeding the containers in a specified orientation to a pod collecting station with one of the edges of the pods exposed, tilting the pods at the pod collecting station to permit proper stacking of the pods, and pressing the adhesive surface of a tape into engagement with the exposed edges of the pods at the pod collecting station. The tape with the pods adhering thereto is advanced to form a strand of the pod-tape product.

One of the objects and advantages of the present invention is to provide a method for adhering rupturable photographic pods onto a tape to form a photographic pod-tape product.

The invention and its objects and advantages will become more apparent from the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
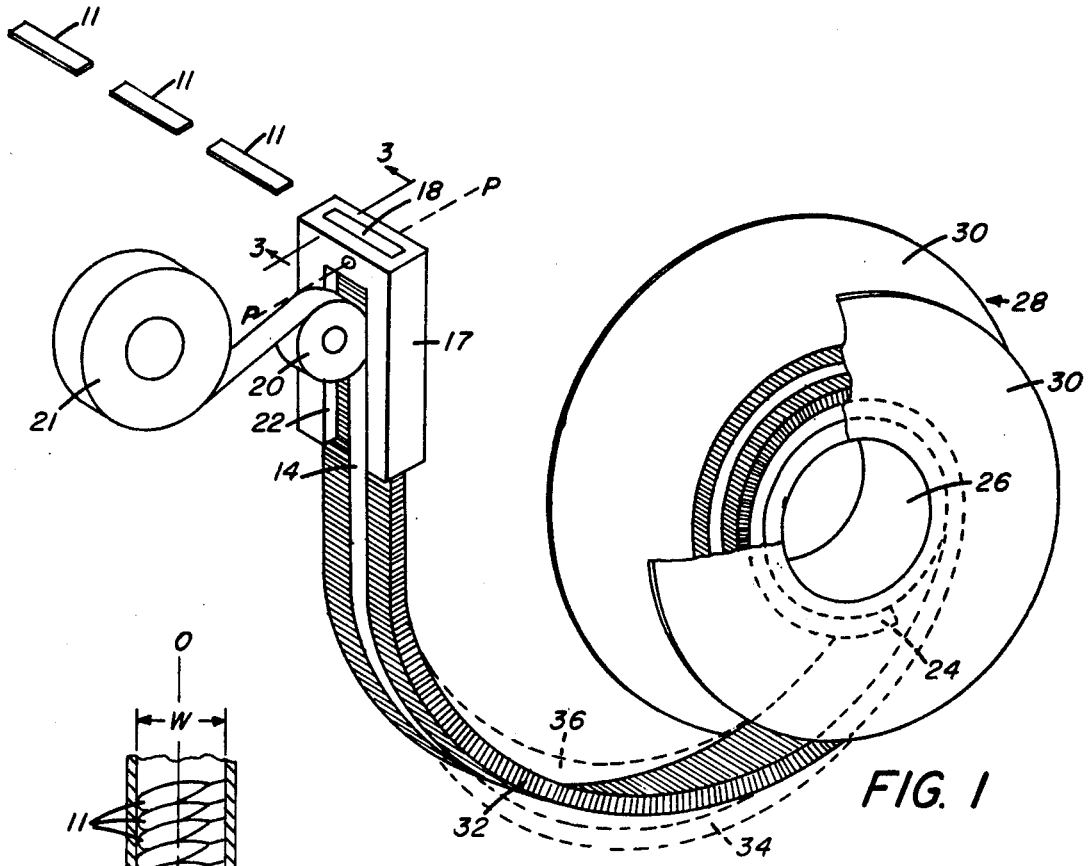
FIG. 1 is a schematic view in perspective of an apparatus for forming a photographic pod-tape product.
Figure 3:
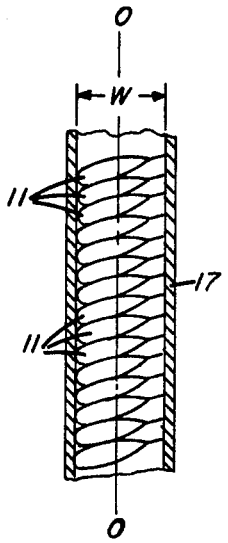
FIG. 3 is a view taken substantially along line 3—3 of FIG. 1 illustrating how the pods are stacked.

With reference to FIGS. 1-4 of the drawings, a photographic pod-tape product 10 (FIG. 2) of this invention comprises a plurality of rupturable photographic pods 11 which are secured along complementary edges 12 to the adhesive surface of a tape 14. The tape 14 can be any suitable masking tape or the like having an adhesive surface on one side. The photographic pods 11 each comprise a deformable sheet material which is folded or bent along edge 12 to form a pair of overlapped facing rectangular walls. A liquid photographic processing agent of a type suitable for processing an exposed photosensitive or image-recording sheet is introduced by any suitable means between the walls. The walls are secured to one another on the remaining three marginal edges by a heat seal 16 or the like to form a pod 11 containing the liquid photographic processing agent. The photographic pods 11 may also be formed by superimposing a pair of discrete rectangular walls of deformable sheet material in spaced relation, inserting a liquid photographic processing agent between the walls, and then securing the walls together along all four marginal edges.

Figure 4:
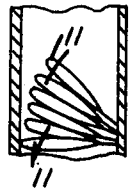
FIG. 4 is a segmental view similar to FIG. 3 illustrating how the pods are stacked in a chute in which the width thereof is equal to the width of the pods.

The mechanism or apparatus for forming the photographic pod-tape product 10 is illustrated schematically in FIG. 1, and comprises a rectangular pod collecting chute 17 having a passageway 18 extending therethrough for receiving photographic pods 11 fed therein in a predetermined orientation by any suitable means. The width W of the passageway 18 is less than the width of a pod 11 (FIG. 3) so that the pods when introduced into passageway 18 are tilted relative to the longitudinal axis 0—0 of passageway 18 to permit proper stacking of pods 11 within chute 17. If the width W of the passageway is equal to the width of pods 11 as illustrated in FIG. 4, the pods, which are thicker along the folded edge 12 than the opposite sealed edge 16 will stack improperly. In applicants' apparatus, it has been found preferable to momentarily inhibit the free fall of the thinner edge 16 permitting the thicker edge 12 to tilt downwardly relative to the thinner edge.

Figure 2:
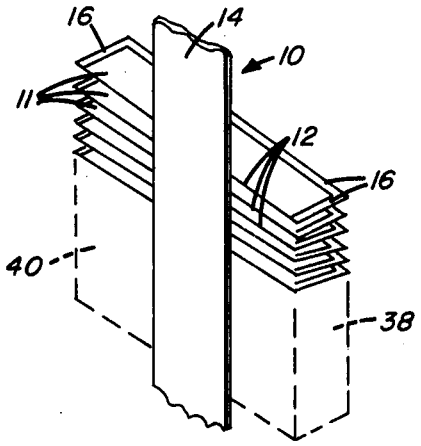
FIG. 2 is an enlarged segmental view of a portion of the photographic pod-tape product illustrated in FIG. 1.

The mechanism for applying tape 14 to the edges 12 of the stack of pods 11 fed into chute 17 comprises a tape applicator drive roller 20 over which the tape fed from a tape supply reel 21 is trained. The applicator roller 20 is mounted to extend through an elongated slot 22 in one side of chute 17 with the periphery of the roller engaging complementary edges of the pods stacked in the chute. The roller 20 presses the adhesive surface of tape 14 against the edges 12 of the pods 11 which adhere to the tape forming a photographic pod-tape product 10 as illustrated in FIG. 2. The leading end 24 of the pod-tape product 10 is manually secured by any suitable tape or the like to a core 26 of a product take-up reel 28 having a pair of guide flanges 30 on each side thereof. The product take-up reel 28 is mounted on an arbor, not shown, which is driven by any suitable motor preferably controlled by the position of a loop 32 of pod-tape product 10 extending between chute 17 and product take-up reel 28. Any suitable optical or fluidic sensing mechanism or the like, not shown, can be provided for sensing lower and upper positions 34, 36 respectively (shown dotted in FIG. 1) of the photographic product loop 32. If the loop enlarges to the lower position 34, the sensing mechanism is actuated, which in turn actuates the drive motor for reel 28. The motor winds up the pod-tape product 10 until the product loop 32 shortens to the upper position 36, actuating another sensing mechanism for inactivating the drive motor. The collecting chute 17 is preferably provided with a slot opposed to slot 22 and a back up roller opposed to applicator roller 20 arranged to engage the opposite marginal edge 16 of the pods 11. The pods are fed one at a time into the entry end of passageway 18 by any suitable transport mechanism such as a belt conveyor or the like, not shown.

In the method of forming a photographic pod-tape product 10 with an apparatus of the type described, a roll of tape 14 is mounted on the tape supply reel 21 and the leading end thereof trained over tape applicator roller 20. The adhesive surface of the tape faces the exposed marginal edges 12 of the pods 11 introduced into collecting chute 17. A stop member such as a rectangular block 38 of any suitable type conforming to passageway 18 and illustrated by dotted lines in FIG. 2 is inserted into the passageway into engagement with the periphery of roller 20 to provide a stop for the pods 11 fed into chute 17 so that they do not fall through the chute. The pod feeding mechanism such as a conveyor belt is operated to feed the pods 11 in a predetermined orientation one at a time into the entry end of passageway 18 where they drop by gravity and are tilted during their free fall to form a stack of tilted pods on block 38. When chute 17 is almost filled with such a stack of tilted pods 11, a beam of light P-P from any suitable light source is blocked, activating a photocell or the like which in turn actuates tape applicator drive roller 20 for transporting and applying tape to the outer surface 40 of block 38 and to marginal edges 12 of pods 11. The transported tape advances the block and pods through chute 17. The block 38 is manually removed from tape 14, and the leading end 24 of the photographic pod-tape product 10 is manually attached to core 26 on the product take-up reel 28. The drive motor for reel 28 is intermittently operated in response to lower and upper positions 34, 36 respectively of the product loop 32 between feed chute 17 and product take-up reel 28 for winding the pod-tape product 10 onto the reel.

Figure 6:
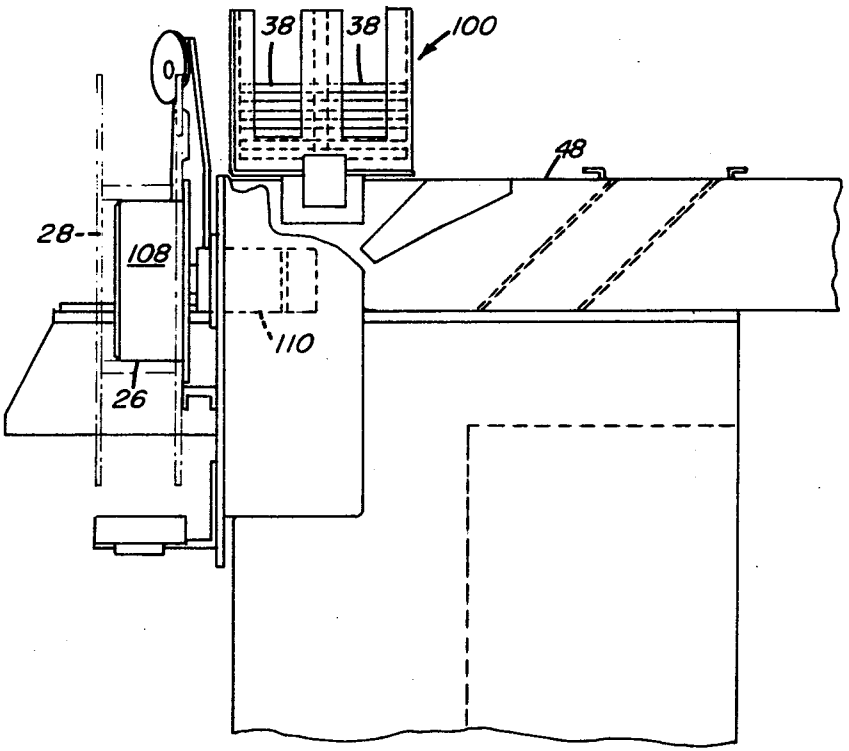
FIG. 6 is a side elevational view of the apparatus of FIG. 5.
Figure 5:
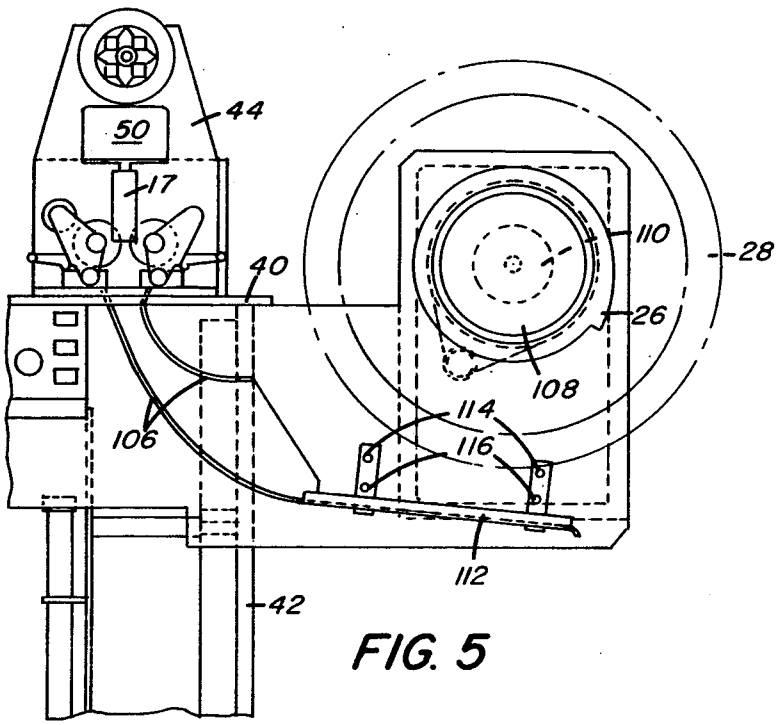
FIG. 5 is a front elevational view of a preferred embodiment of an apparatus for forming a photographic pod-tape product.
Figure 7:
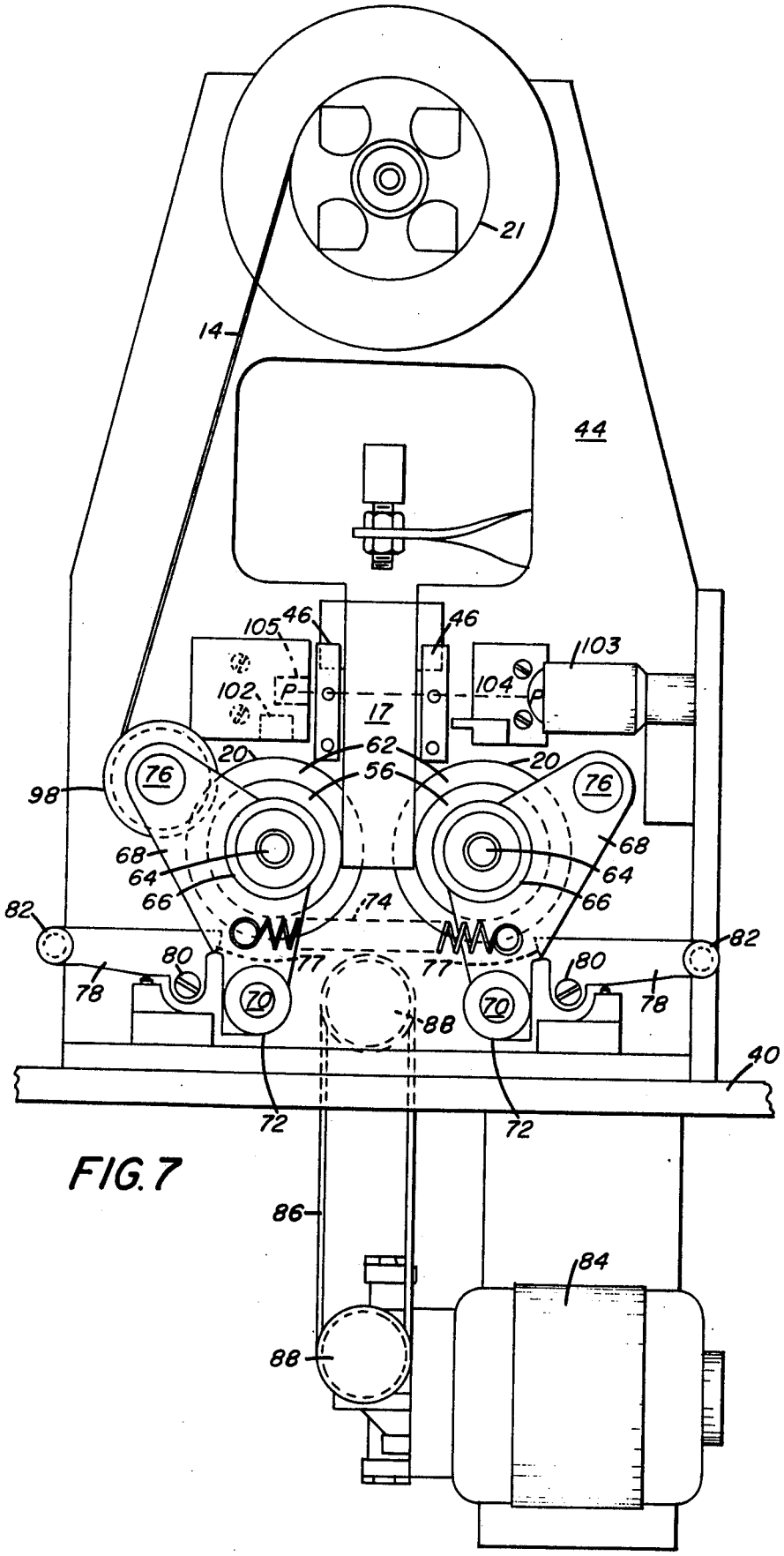
FIG. 7 is an enlarged front elevational view of a portion of the mechanism of FIG. 5.
Figure 8:
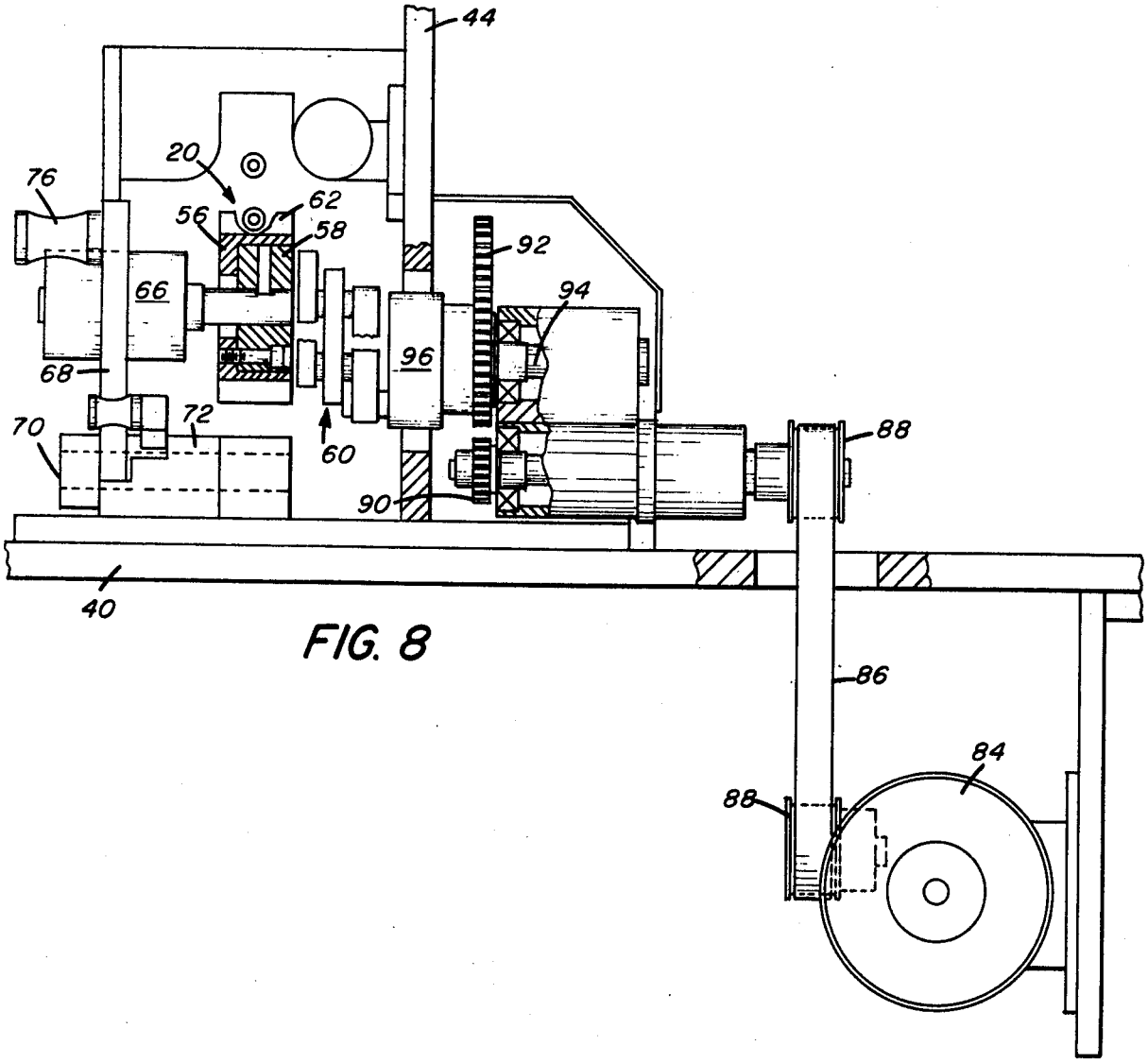
FIG. 8 is a side elevational view of the mechanism of FIG. 7.
Figure 9:
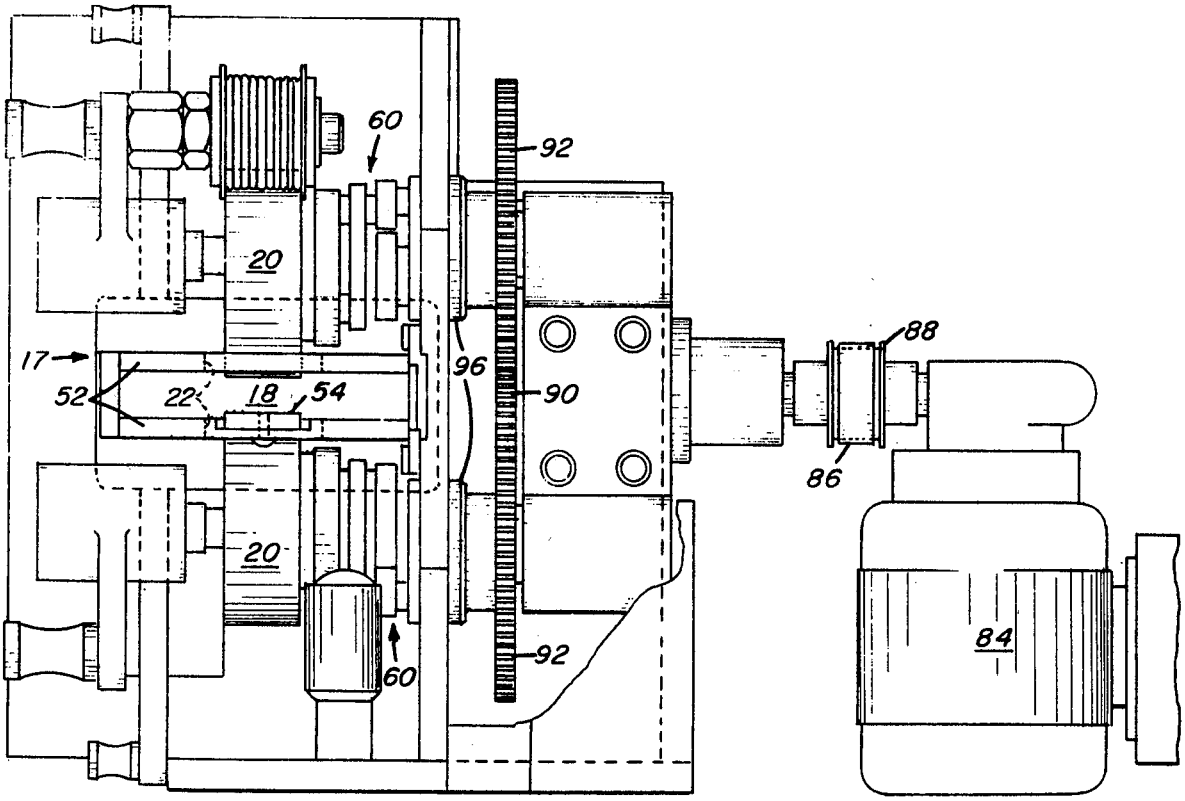
FIG. 9 is a top plan view of the mechanism of FIG. 8.

A preferred embodiment of the apparatus for forming the photographic pod-tape product 10 is illustrated in FIGS. 5–8. In this embodiment, parts similar to parts described heretofore will be denoted by the same numerals. The apparatus comprises a horizontally mounted base plate 40 on a stand 42 to which a vertically arranged mounting plate 44 is secured. A substantially rectangular pod collecting chute 17 is releasably mounted by any suitable means such as retaining clips 46 (FIG. 7) to mounting plate 44. The chute 17 is mounted with the upper open end of passageway 18 (FIG. 9) in alignment with and slightly below a pod transport belt 48 (FIG. 6). The pods 11 are presented in a row on belt 48 in a predetermined orientation with the thicker edges 12 aligned on one side and the thinner edges 16 aligned on the opposite side. The belt transports the photographic pods 11 one at a time through opening 50 in mounting plate 44 where they drop by gravity into passageway 18 of chute 17. One of the side plates 52 (FIG. 9) of chute 17 is provided with a wedge 54 secured thereto for narrowing the width of passageway 18. Accordingly, the thinner edges 16 of the dropped pods 11 successively strike wedge 54 causing the pods to tilt and assume an inclined stacking position as described heretofore. The side plates 52 are provided at their lower ends with slots 22 through which tape-applying and back-up rollers 20 extend. The rollers 20 are substantially identical in construction, and each comprise a sleeve 56 (FIG. 8) secured to a disk 58 at one end of a commercially available eccentric coupling 60 such as a commercially available Schmidt coupling. A soft tire 62 of rubber or the like is mounted on sleeve 56. The disk 58 is further secured to one end of a shaft 64, the opposite end of which is journaled in a bearing housing 66. The housing 66 is mounted on a bracket 68 pivotal about a shaft 70 carried by a block 72 secured to base plate 40. The rollers 20 are biased toward one another by a helical spring 74 (FIG. 7) interconnecting brackets 68. When it is desired to remove chute 17 for cleaning or the like, the brackets 68 are pivoted by knobs 76 secured thereto to a retracted position withdrawing rollers 20 clear of chute 17. Each bracket 68 is releasably held in its retracted position by a latch 78 pivotally mounted on pin 80, and having a recessed portion spring biased into engagement with a pin 77 on bracket 68. The brackets 68 are released by pivotal movement of latches 78 by handles 82 in a direction for releasing pins 77. Each of the rollers 20 is rotatably driven (FIG. 8) by a drive motor 84 coupled by a belt 86, pulleys 88 and gears 90, 92 to a shaft 94 secured to the opposite disk 96 of coupling 60.

A tape reel 21 (FIG. 7) for receiving a roll of tape 14 is mounted on a spindle supported by mounting plate 44. The tape 14 from tape reel 21 is trained over a soft tire guide idler roller 98 mounted on a bracket 68, and then over tape-applicator roller 20 which presses the adhesive surface of the tape against a stack of photographic pods 11 fed into chute 17.

Before pods 11 are fed into chute 17, a stop member described heretofore as a block 38 is introduced into the entry end of passageway 18 of chute 17 to block the exit end thereof and prevent the pods from falling through the chute. The block member 38 can be manually inserted into chute 17, or automatically by means of a block injector 100 (FIG. 6). The block injector is mounted adjacent to transport belt 48, and on signal will feed a block 38 onto the belt which transports it into the entry end of the passageway 18 of the chute. The weight of the block 38 is designed to introduce the block into the nip of rollers 20. As the pods 11 transported by belt 48 fill the chute to a predetermined level, the light beam P—P from a light source 103 (FIG. 7) is blocked causing a photo-conductive cell 105 to actuate drive motor 84 for driving rollers 20 and feeding the photographic pod-tape product 10 and block 38 out of the exit end of chute 17. If a jam occurs in chute 17 causing a gap in the stack of pods 11, than a photo-conductive cell 104 receives light from a light source 102 causing a reject system coupled to the pod transport mechanism to be activated, and preferably deactivating drive motor 84. Accordingly, no pods are received from the transport mechanism until the jam is cleared and photo-conductive cell 104 is blocked from receiving light. The product 10 exiting from chute 17 passes between guide plates 106 (FIG. 5), and the operator removes the block and manually attaches the leading end 24 of the pod-tape product to a take-up core 26 mounted on a take-up spindle 108 driven by a motor 110. Sensing means such as photodetectors 114, 116 are mounted on a support plate 112 in spaced relation to detect lower and upper positions 34, 36 (FIG. 1) of the loop 32 formed by the pod-tape product 10. If the lower position 34 of the loop is sensed, motor 110 is actuated to drive take-up spindle 108 and wind up the pod-tape product. When the upper position 36 of the loop is sensed, motor 110 is deactivated.

The invention has been described in detail with particular reference to preferred embodiments, but it will be understood that variations and modifications can be effected within the spirit and scope of the invention as described.

We claim:

1. A method of handling a plurality of articles, each having a thick marginal edge and an opposite thinner marginal edge, by adhering the articles to a tape having an adhesive surface to form an article-tape product, said method comprising the steps of:

tilting said articles at said article collection station so that said thick marginal edge of each article is below its opposite thinner marginal edge;

stacking said tilted articles one on top of another at said article collecting station with corresponding thick marginal edges of said articles in alignment;

applying the adhesive surface of the tape to said aligned thick marginal edges of said stack to form an article-tape product;

and removing the article-tape product from the article collecting station.

2. The method according to claim 1 comprising the further step of winding the article-tape product into a roll.

3. A method for adhering rupturable photographic pods onto a tape to form a photographic pod-tape product wherein the pod is of the type formed from a single sheet of deformable material folded along one marginal edge to form a pair of overlapping rectangular walls secured to one another along the remaining marginal edges to form a cavity containing a liquid photographic processing agent, each pod being thicker along said folded marginal edge than the opposite secured marginal edge, comprising the steps of:

feeding photographic pods one at a time to a pod collecting station with each pod in the same predetermined orientation relative to the station;

tilting said pods at said pod collecting station with said folded marginal edge of each pod lower than said opposite secured marginal edge;

stacking said tilted pods at said pod collecting station to form a stack of tilted pods having said folded marginal edges in register; and applying the adhesive surface of a tape into engagement with said registered folded marginal edges of said stack to form a photographic pod-tape product.

4. The method according to claim 3 comprising the further step of transporting the photographic pod-tape product from said pod collecting station.

5. The method according to claim 4 comprising the further step of winding the transported pod-tape product into a roll.

6. The method according to claim 4 comprising the further steps of:

winding the transported pod-tape product into a roll;

forming a pod-tape product loop between said pod collecting station and said roll;

sensing lower and upper positions of said pod-tape product loop, and in response thereto; and activating a motor driving said roll when the lower loop position is sensed and deactivating said roll driving motor when the upper loop position is sensed.

7. The method according to claim 4 comprising the further steps of:

sensing the height of the stack of tilted pods at said pod collecting station, and when a predetermined height is reached;

activating a transport motor for achieving said transporting step.

8. The method according to claim 4 comprising the further steps of:

sensing a gap formed in the stack of tilted pods caused by a jam, and in response thereto;

discontinuing said pod feeding step.

9. The method according to claim 8 comprising in response to said gap sensing step the further step of:

deactivating a transport motor for discontinuing said pod-tape product transporting step.

* * * * *